US005860879A

United States Patent [19]

Gable

[11] Patent Number: 5,860,879

[45] Date of Patent: Jan. 19, 1999

[54] THROW AND CATCH TOY

[76] Inventor: Derek J. Gable, 7246 Avenida Alisima, Rancho P.V., Calif. 90275

[21] Appl. No.: 940,031

[22] Filed: Sep. 29, 1997

[51] Int. Cl.[6] ..... A63B 65/00

[52] U.S. Cl. ..... 473/575; 473/579

[58] Field of Search ..... 473/574, 575, 473/576, 578, 579, 581, 582, 583, 585, 595, 613, 580, 569, 286; D21/204, 206, 207

[56] References Cited

U.S. PATENT DOCUMENTS

| | | | |
|---|---|---|---|
| 1,393,407 | 10/1921 | Tenney | 473/580 |
| 1,830,520 | 11/1931 | Moyses | 473/286 |
| 2,009,759 | 7/1935 | Brown | 473/579 |
| 2,377,498 | 6/1945 | Jacke | 473/569 |
| 3,514,109 | 5/1970 | Grow | 473/576 |
| 4,101,128 | 7/1978 | Yellen | 473/579 |
| 4,266,781 | 5/1981 | Blue | 473/575 |
| 4,928,977 | 5/1990 | Chambers | 473/569 |

*Primary Examiner*—Steven B. Wong
*Attorney, Agent, or Firm*—Myron Amer PC

[57] ABSTRACT

A badminton shuttlecock-type article of manufacture used primarily as a throwing toy against a wall having a novel "flip" during rebounding caused by a rubber ball front, in which distortion of the rubber ball upon impact against the wall is confined to the rubber ball surface making contact, and this increases the flight of the rebound to an extent that the challenge of catching the toy on the rebound is part of its play value.

1 Claim, 2 Drawing Sheets

FIG. 1
PRIOR ART
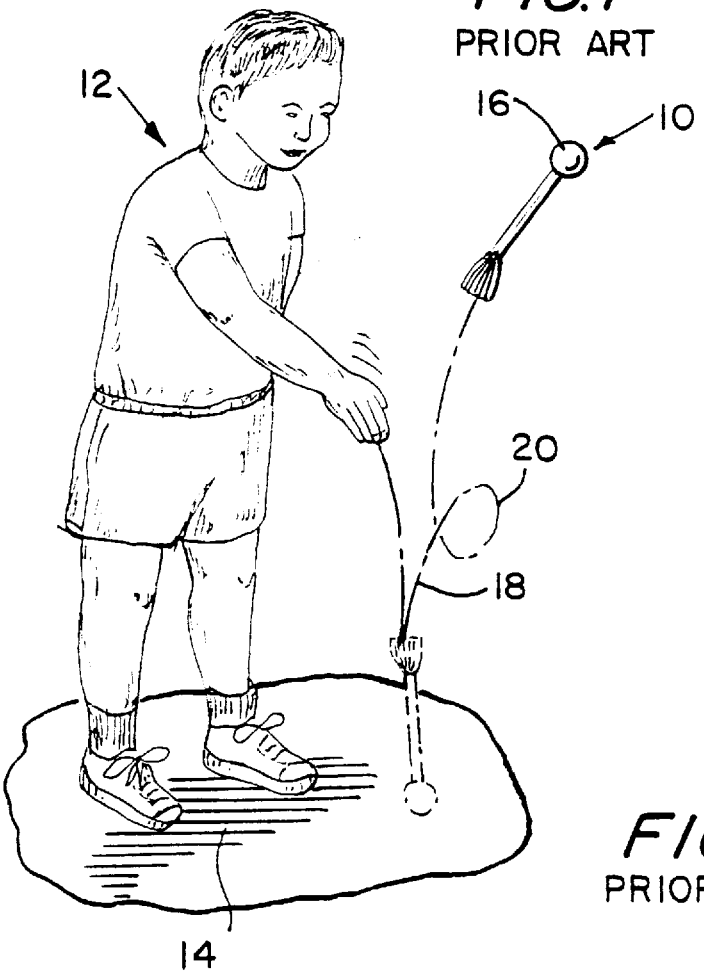
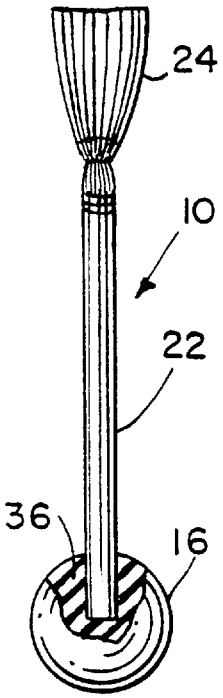
FIG. 2
PRIOR ART
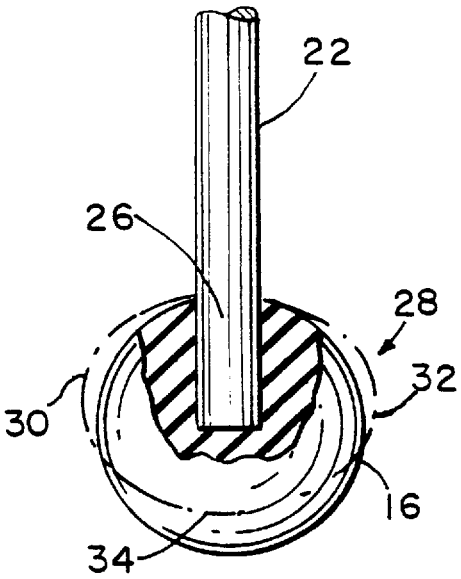
FIG. 3
PRIOR ART

THROW AND CATCH TOY

The present invention relates generally to a toy rubber ball with attached flight-controlling vanes, similar to a badminton shuttlecock, having play value as a throw-and-catch toy, and more particularly to improvements lengthening the rebounding flight of the toy so that the play value thereof is increased to the user by presenting a challenge to catch the toy.

EXAMPLE OF THE PRIOR ART

Toys that are thrown against, and rebound off a wall, are already well known, as exemplified by U.S. Pat. No. 4,266,781 issued to Walter L. Blue for "Resilient Rotatable Toy" on May 12, 1981. The play value of the '781 and all other known similar toys resides in an observable "flipping" phenomenon as the toy changes direction from the thrown flight in one direction to a rebounding flight in an opposite direction. While noteworthy, the play value attributable to the observed "flip" is unnecessarily limited and heretofore has not used to advantage that the rebounding flight is back to the user and accordingly should include the additional play value of presenting the challenge of making a catch of the toy to the user.

Broadly, it is an object of the present invention to provide a throw-and-catch toy overcoming the foregoing and other shortcomings of the prior art.

More particularly, it is an object to control the impact-causing distortion of the rubber ball attached to the front end of the toy, so that the urgency resulting from the recovery from the distorted back into a spherical shape significantly lengthens the rebound flight and provides the noted challenge to catch the toy, all as will be better understood as the description proceeds.

The description of the invention which follows, together with the accompanying drawings should not be construed as limiting the invention to the example shown and described, because those skilled in the art to which this invention appertains will be able to devise other forms thereof within the ambit of the appended claims.

FIG. 1 is a perspective view of a known throw-and-catch toy over which the within inventive throw-and-catch toy is a noteworthy improvement;

FIG. 2 is a front elevational view, partly in section, of the prior art toy of FIG. 1;

FIG. 3 is a partial front elevational view of the rubber ball component of the toy of FIGS. 1, 2;

Figure 4:
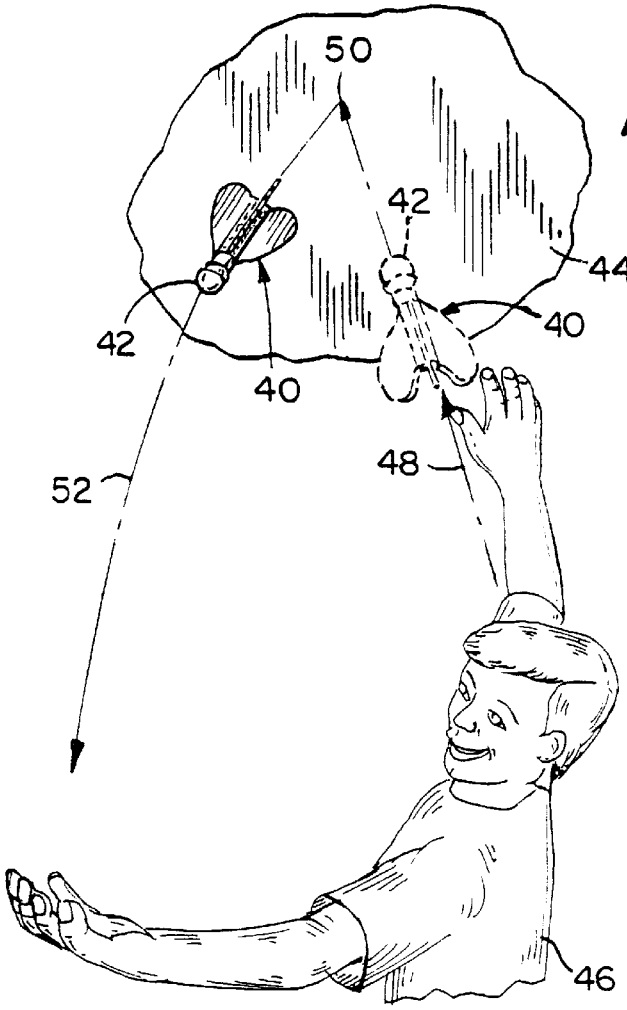
Figure 5:
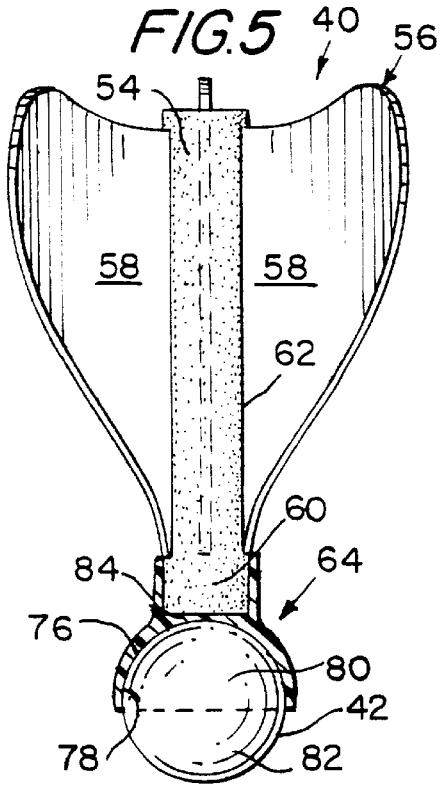
Figure 6:
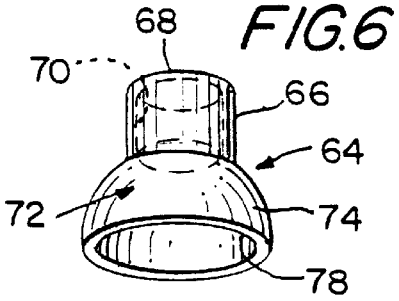
Figure 7:
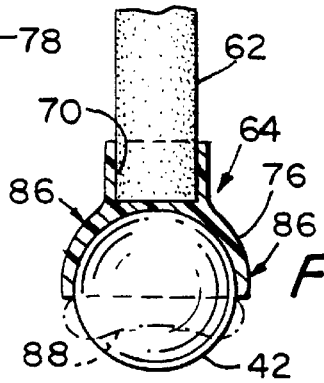

FIGS. 4–7, inclusive, illustrate the within inventive throw-and-catch toy. More particularly, FIG. 4 is a perspective view of the contemplated manner in which the toy is thrown so as to be caught on the rebound from a wall surface by a user;

FIG. 5 is a front elevational view, partly in section, of the within inventive toy;

FIG. 6 is an isolated perspective view of a front component of the toy of FIG. 5; and FIG. 7 is a partial perspective view of the front end of the FIG. 7 toy illustrating in phantom perspective an aspect of its operational mode.

It is already known, as exemplified by, and as illustrated in prior art FIGS. 1, 2 and 3, that a dart-like toy 10 thrown by a user 12 against a surface 14 will, because of a front end rubber ball 16, rebound off the surface 14 in a return direction 18 towards the user 12 and during its return flight 18 partake of a 360 degree flip, as at 20. The flip 20 adds play value to the toy 10 and also, in accordance with the present invention, introduces a mode of use which makes the toy 10 catchable provided the return flight 18 is of a sufficient length to bring it within reach of the user 12, which is not always the case with the prior art toy 10.

More particularly, toy 10 and all other similar known "flip" toys are, as best illustrated in FIG. 2, constructed with a tubular plastic or rubber body 22 having flight-controlling vane means 24 at a distal end, and at a front or opposite proximal end a rubber ball 16 attached by the projection of the tubular body 22 frictionally or adhesively into the rubber ball 16, as at 26. As best shown in FIG. 3, the noted method of attaching the rubber ball 16 to the front end of the body 22 permits distortion of the rubber ball, as noted by the phantom reference lines 28, upon the striking of the surface 14 (not shown in FIG. 3). More particularly, the distortion 28 includes side bulges of the elastomeric or rubber construction material of the ball 16, as at 30 and 32, and also a front compression as at 34. In practice it has been found that the side bulges at 30, 32 when compressing under the urgency of the elastomeric material 36 are not effective in contributing to the length of travel along the return flight 18, but that it is primarily the recovery from the front compression 34 that determines the length of the return flight 18.

The same adverse consequence would lessen the length of the return flight of the inventive toy, generally designated 40, were it not for the restraint of the distortion of the rebound-producing rubber ball 42 upon impact against a wall surface 44, as will now be explained in connection with FIGS. 4–7.

As best understood from FIG. 4, the contemplated use of the toy 40 is to be thrown by a user 46 along a flight path 48 bringing a rubber ball 42 into contact with a wall surface 44, as at 50, and cause the rebounding of the toy 40 along a return flight 52 which, in accordance with the present invention, is of a sufficient length in most instances to locate the toy 40 within reach of the user 46 and thus catchable. Thus, adding to the previously noted "flip" phenomenon, the play value of the toy 40 is supplemented by a challenge to the user 46 to catch the rebounding toy.

Constructionwise the toy 40 includes a rear end-attached, as at 54, vane means, generally designated 56, consisting of two, and optionally three, individual vanes 58 which are appropriately secured, as by adhesive or the like, to the body rear end 54, and which vane means 56 functions in a well understood manner to keep the toy 40 on a straight ahead course during flights 48 and 52.

At the opposite or front end 60 of the body 62, toy 40 has an attaching member 64 shown in isolated perspective in FIG. 6 which has a hollow tubular configuration 66 having an internal cylindrical wall 68 bounding a compartment 70 of a selected size and shape to receive in projected relation therein the body front end 60.

Member 64 is preferably of plastic construction material and molded integral therewith is a ball-attaching means, generally designated 72, having a hemispherical shaped configuration generally designated 74 having a hemispherical wall 76 which bounds an internal hemispherical compartment 78 which, it is to be understood, is of a selected size and shape to have seated therein the rubber ball 42. The seating, more particularly, is by the diameter size and shape of compartment 78 and the diameter of the rubber ball 42 selected so as to confine the rear half of the rubber ball 80 within the wall-bounded compartment 78 and leaving exposed the front half, designated 82, of the rubber ball 42. An appropriate adhesive 84 is advantageously used to secure the tubular configuration 66 to the body front end 60 and to hold the rubber ball 42 in place within compartment 78.

As a consequence of the restraint, as at 86, exercised by the attaching member wall 74 on the sides of the rubber ball 42, it has been found in practice that distortion caused by impact of the exposed half 82 of the rubber ball 42 against the wall surface 44 results only in a front compression 88 and occurs to a greater extent, all factors being equal such as the throwing force, etc., than the front compression 34 of the prior art and all other known "flip" toys 10. Thus the resuming of the spherical shape of the front half 82 of the deformed rubber ball 42, a condition of which is shown in FIG. 7, causes a length in the rebound flight 52 which presents a catching challenge to the user 46.

While the toy article of manufacture herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. Improvements for a throw and catch toy of a type having at opposite front and rear ends thereof a front end-attached rubber ball and a rear end-attached vane means in the use of which said rubber ball rebounds off a wall surface and said vane means controls initially the flight of said toy into contact with said wall surface and subsequently in said rebound flight from said wall surface, said improvements being an attachment of a front end of said toy to said rubber ball comprising a selected diameter of said rubber ball and a selected construction material that is compressible in response to contact with a wall surface into a distorted ball shape in front and in adjacent sides of said ball, ball-attaching means extending from said toy characterized by a wall bounding a correspondingly hemispherical compartment of a selected diameter, said selected diameters of said ball and of said compartment being approximately equal, and an operative position of said rubber ball adhesively seated in said compartment so that said compartment-bounding hemispherical wall obviates shape distortion in adjacent sides of said rubber ball and limits shape distortion to the front thereof making contact with said wall surface, whereby an urgency of said distortion confined to said ball front contributes to increasing the length of travel of said toy during said rebounding flight from said wall surface.

* * * * *